US011377330B2

(12) United States Patent
Jackson

(10) Patent No.: US 11,377,330 B2
(45) Date of Patent: Jul. 5, 2022

(54) REMOTE CONTROLLED LIFT ASSEMBLY

(71) Applicant: Charles Jackson, Tylertown, MS (US)

(72) Inventor: Charles Jackson, Tylertown, MS (US)

( * ) Notice: Subject to any disclaimer, the term of this patent is extended or adjusted under 35 U.S.C. 154(b) by 146 days.

(21) Appl. No.: 16/838,201

(22) Filed: Apr. 2, 2020

(65) Prior Publication Data

US 2021/0309498 A1 Oct. 7, 2021

(51) Int. Cl.

| | |
|---|---|
| ***B66D 3/24*** | (2006.01) |
| ***B66D 3/00*** | (2006.01) |
| ***B66D 1/58*** | (2006.01) |
| ***B66D 3/26*** | (2006.01) |
| ***B66D 1/60*** | (2006.01) |

(52) U.S. Cl.

CPC ..... *B66D 3/24* (2013.01); *B66D 1/58* (2013.01); *B66D 1/605* (2013.01); *B66D 3/006* (2013.01); *B66D 3/26* (2013.01); *B66D 2700/0108* (2013.01); *B66D 2700/025* (2013.01)

(58) Field of Classification Search

USPC ..... 254/323

See application file for complete search history.

(56) References Cited

U.S. PATENT DOCUMENTS 5,813,642 A 9/1998 Warren
5,820,109 A * 10/1998 Jermyn ..... B63G 7/02 254/362
6,173,539 B1 1/2001 Barnes
6,401,863 B1 * 6/2002 Kirkland ..... B66D 3/20 182/142
10,123,527 B1 * 11/2018 Leger, Sr. ..... A01M 31/006
10,549,967 B1 * 2/2020 Weis ..... B66D 3/006
2004/0188088 A1 * 9/2004 Newman ..... B66D 1/485 166/250.01
2007/0039707 A1 2/2007 Karenbauer
2007/0107276 A1 5/2007 Peterson
2007/0220788 A1 9/2007 McCray
2008/0023681 A1 * 1/2008 Cunningham ..... B66D 3/20 254/362
2011/0146124 A1 6/2011 Carlson
2015/0191334 A1 * 7/2015 Heravi ..... G08C 17/02 701/48
2015/0307332 A1 * 10/2015 Huang ..... B66D 1/28 254/323
2016/0339277 A1 * 11/2016 Angelopoulos ..... B66F 11/04
2018/0170726 A1 * 6/2018 August ..... B66D 1/485
2018/0296861 A1 * 10/2018 Rogge ..... A62B 1/10
2019/0127186 A1 * 5/2019 Lolle ..... B66C 7/04
2019/0337776 A1 * 11/2019 Fanello ..... B66C 15/065
2020/0039663 A1 * 2/2020 Avena De Azevedo ..... B64B 1/52
2020/0095784 A1 * 3/2020 Rakhmatulin ..... E04G 5/00

* cited by examiner

*Primary Examiner* — Charles A Fox
*Assistant Examiner* — William J Gately, III

(57) ABSTRACT

A remote controlled lift assembly includes a pair of supports is each mountable to a respective outrigger of scaffolding. A winch unit is positionable on the supports when the supports are mounted on the scaffolding and the winch unit has a cable extending downwardly therefrom. The cable is lowered or lifted when the winch is actuated. A receiver is coupled to the winch unit and the receiver is in electrical communication with the winch unit. A remote control is provided that is carried by a user and the remote control is in wireless electrical communication with the receiver. In this way the user can remotely lift and lower the cable for lifting and lowering cargo.

8 Claims, 8 Drawing Sheets

REMOTE CONTROLLED LIFT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to lift devices and more particularly pertains to a new lift device for automatically lifting cargo on a scaffold.

(2) Description of Related Art Including Information Disclosed Under 37 CFR 1.97 and 1.98

The prior art relates to lift devices and the prior art discloses a motorized scaffold platform for lifting and lowering a work surface. Additionally, the prior art discloses a novel drive unit for lifting and lowering a scaffolding platform along vertical cables. The prior art discloses a scaffold hoist that includes a winch and a cable and which is mounted atop a leg of scaffolding. The prior art also discloses a portable hoist for lifting heavy objects that includes wheels for rolling on a support surface. The prior art discloses a vertical lift member that includes slidable elements for improving safety of a stanchion climbing hoist.

BRIEF SUMMARY OF THE INVENTION

An embodiment of the disclosure meets the needs presented above by generally comprising a pair of supports is each mountable to a respective outrigger of scaffolding. A winch unit is positionable on the supports when the supports are mounted on the scaffolding and the winch unit has a cable extending downwardly therefrom. The cable is lowered or lifted when the winch is actuated. A receiver is coupled to the winch unit and the receiver is in electrical communication with the winch unit. A remote control is provided that is carried by a user and the remote control is in wireless electrical communication with the receiver. In this way the user can remotely lift and lower the cable for lifting and lowering cargo.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
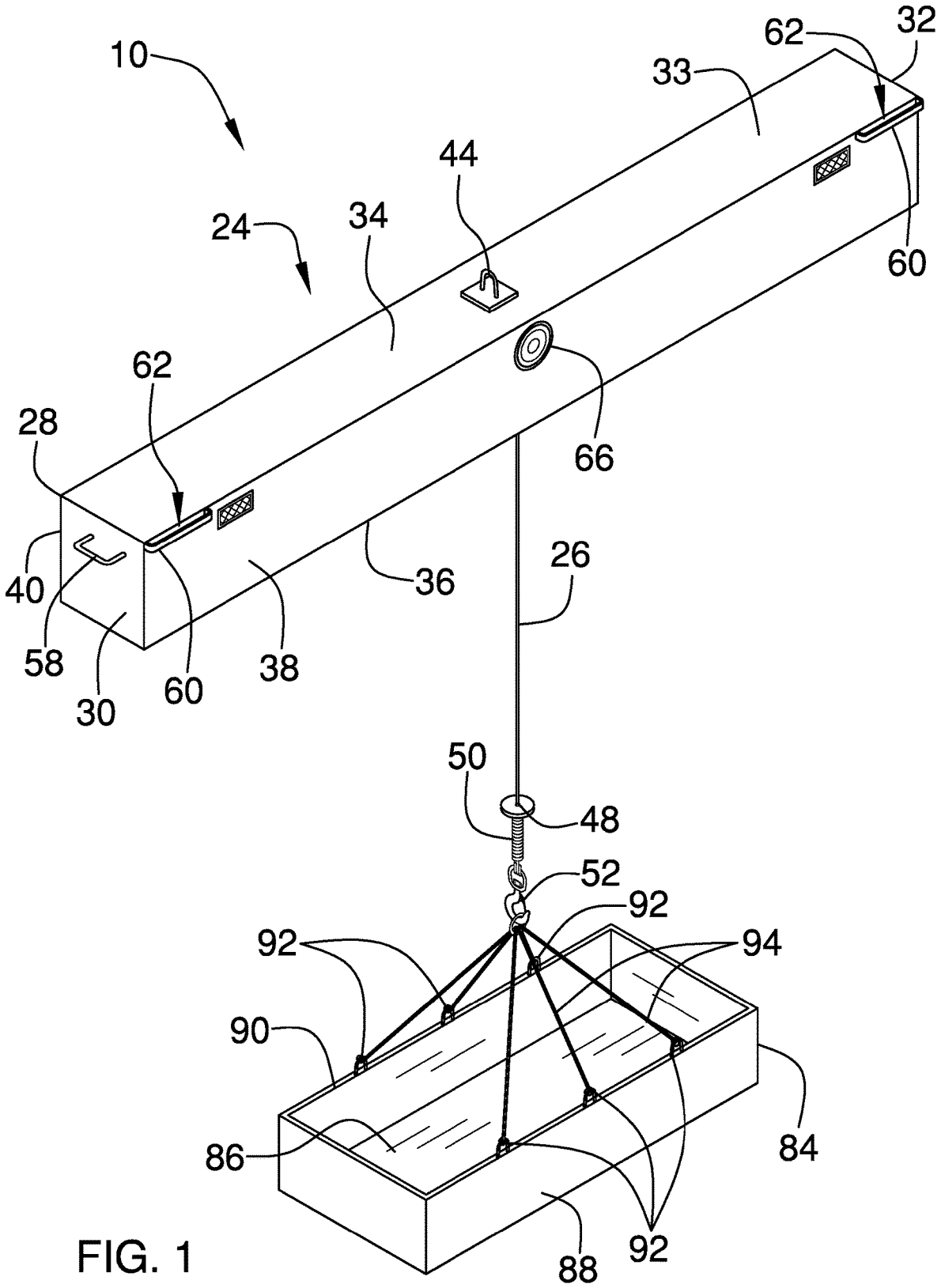
FIG. 1 is a perspective view of a remote controlled lift assembly according to an embodiment of the disclosure.
Figure 2:
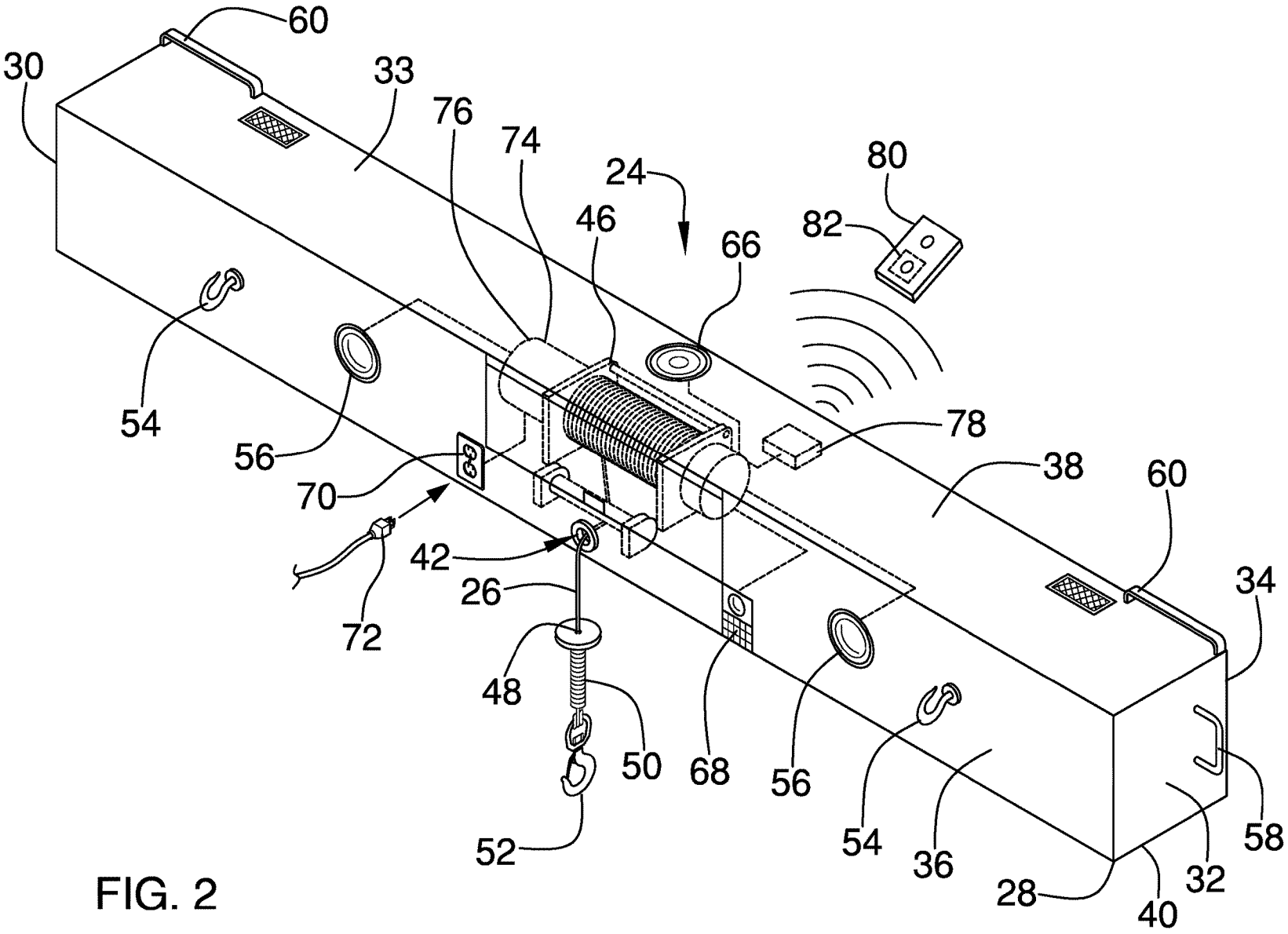
FIG. 2 is a bottom phantom view of a winch unit of an embodiment of the disclosure.
Figure 3:
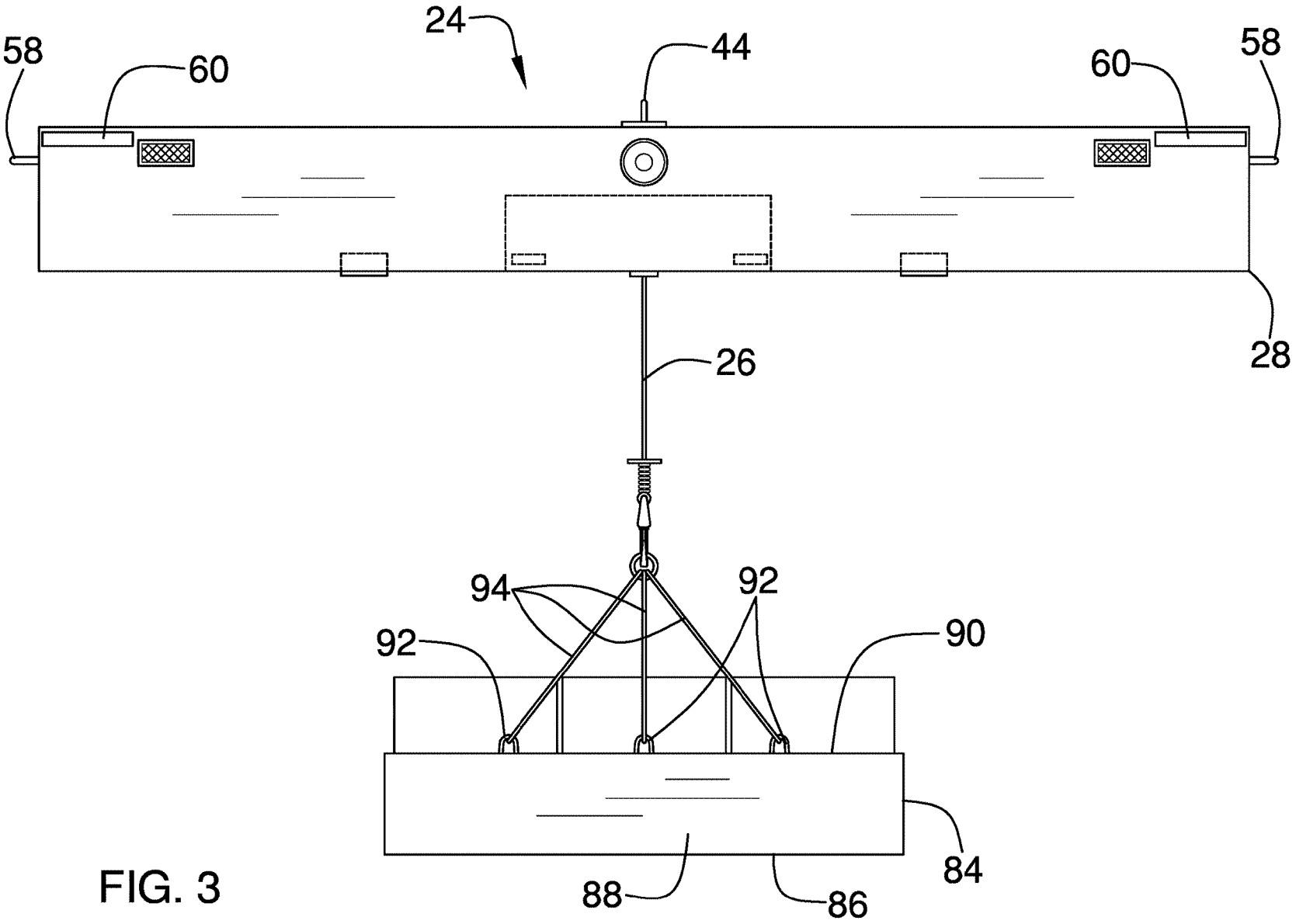
FIG. 3 is a front phantom view of an embodiment of the disclosure.
Figure 4:
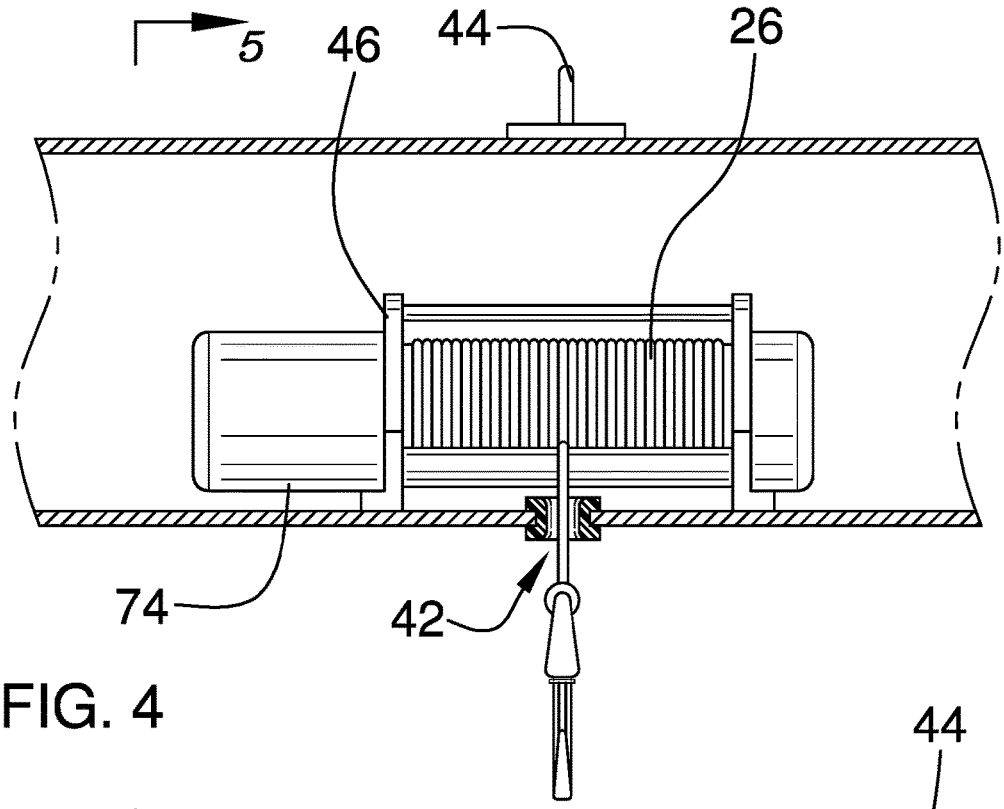
FIG. 4 is a front cut-away view of a winch unit of an embodiment of the disclosure.
Figure 5:
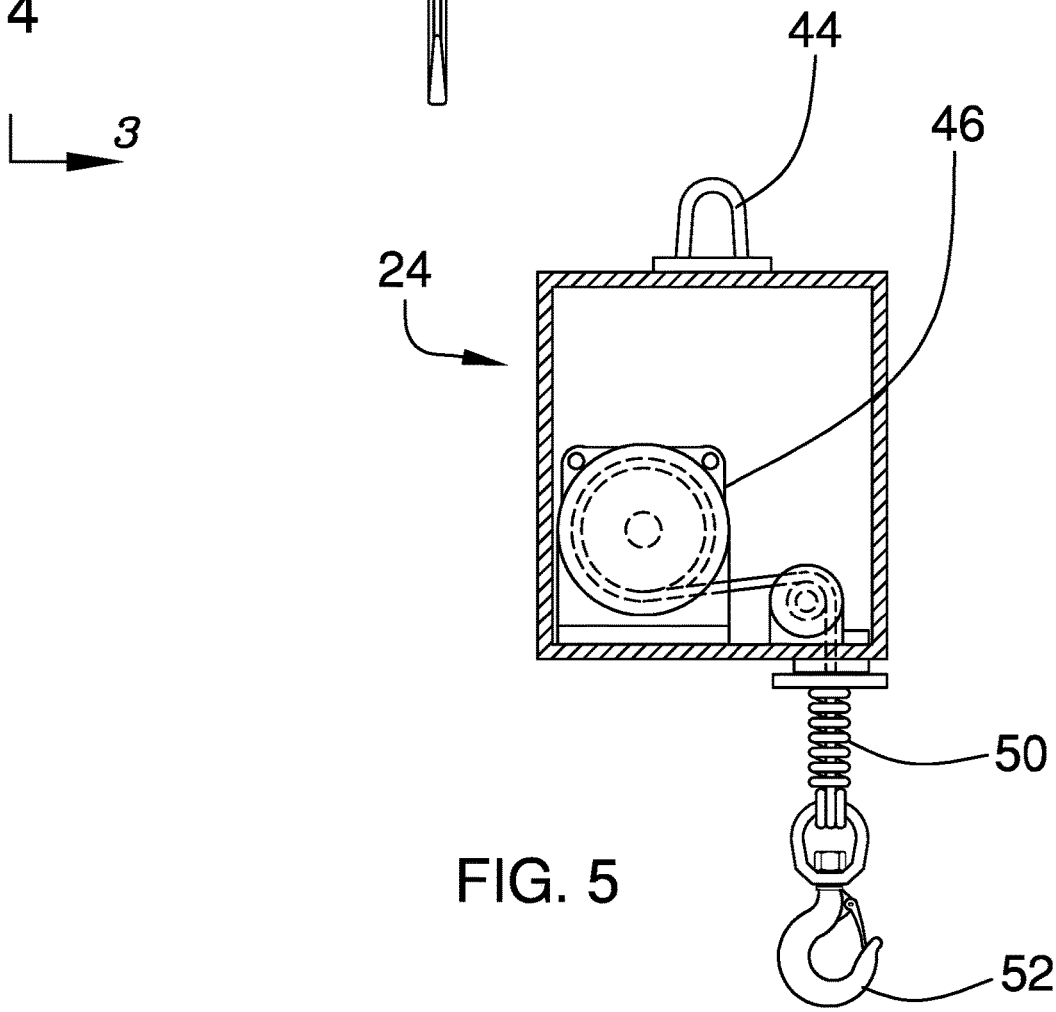
FIG. 5 is a cross sectional view taken along line 5-5 of FIG. 4 of an embodiment of the disclosure.
Figure 6:
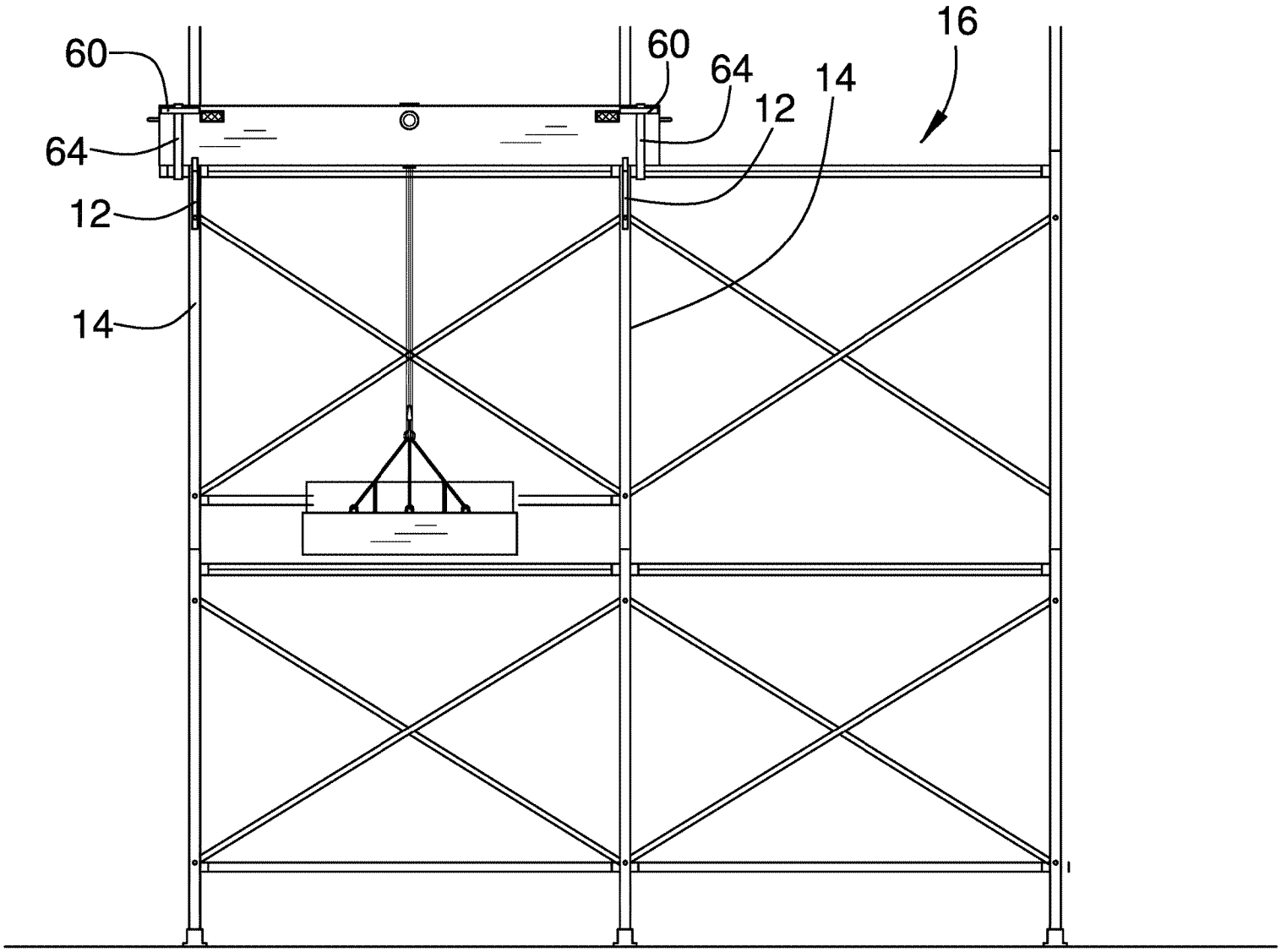
FIG. 6 is a front perspective in-use view of an embodiment of the disclosure.

With reference now to the drawings, and in particular to FIGS. 1 through 9 thereof, a new lift device embodying the principles and concepts of an embodiment of the disclosure and generally designated by the reference numeral 10 will be described.

As best illustrated in FIGS. 1 through 9, the remote controlled lift assembly 10 generally comprises a pair of supports 12 and each of the supports 12 is mountable to a respective outrigger 14 of scaffolding 16. The scaffolding 16 may be scaffolding of any conventional design that is commonly employed at construction sites or the like. Each of the supports 12 has a first member 18, a second member 20 oriented at a right angle with the first member 18. The first member 18 is attachable to the respective outrigger 14 having the second member 20 being oriented to extend along a horizontal axis. Additionally, each of the supports 12 is positionable adjacent to a top end of the scaffolding 16.

A winch unit 24 is positionable on the supports 12 when the supports 12 are mounted on the scaffolding 16 such that the winch unit 24 is spaced upwardly from a support surface on which the scaffolding 16 is positioned. The winch unit 24 has a cable 26 extending downwardly therefrom. The cable 26 is extended outwardly from the winch unit 24 when the winch unit 24 is actuated into a lowering condition. Conversely, the cable 26 is retracted into the winch unit 24 when the winch unit 24 is actuated into a lifting condition. In this way the winch unit 24 can lift or lower building materials, tools, equipment or any other heavy objects that are commonly lifted during the course of a construction project.

The winch unit 24 comprises a housing 28 that has a first end 30, a second end 32 and an outer wall 33 extending therebetween, and the housing 28 is elongated between the first end 30 and the second end 32. The outer wall 33 has a top side 34, a bottom side 36, a front side 38 and a back side 40. The bottom side 36 has a cable aperture 42 extending into an interior of the housing 28 and the cable aperture 42 is centrally positioned between the first end 30 and the second end 32. A suspension loop 44 is coupled to the top side 34 of the outer wall 33 of the housing 28 and the suspension loop 44 can be attached to a suspension line for suspending the housing 28 therefrom. The suspension loop 44 is centrally positioned between the first end 30 and the second end 32 for balancing the housing 28 when the housing 28 is suspended.

A winch 46 is positioned within the housing 28, the winch 46 is aligned with the cable 26 opening and the cable 26 is coupled to the winch 46. The winch 46 turns in a first direction when the winch 46 is turned on for lifting. Additionally, the cable 26 is wrapped around the winch 46 when the winch 46 turns in the first direction to lift a load attached to the cable 26. The winch 46 turns in a second direction when the winch 46 is turned on for lowering. Additionally, the cable 26 is unwrapped around the winch 46 when the winch 46 turns in the second direction to lower the load attached to the cable 26. The winch 46 may be an electric winch that has a lifting capacity of approximately 2000.0 pounds.

The cable 26 has a distal end 48 with respect to the winch 46 and a weight sensor 50 is coupled to the distal end 48 of the cable 26 where to sense the weight of the load on the cable 26. The weight sensor 50 is in electrical communication with the winch 46 and the weight sensor 50 sends a shut off signal to the winch 46 when the weight sensor 50 senses a weight that exceeds a pre-determined trigger weight. In this way the weight sensor 50 inhibits the winch 46 from being overloaded by the weight of the load attached to the cable 26. The weight sensor 50 may comprise an electronic weight sensor, a spring and a switch that is turned on when the spring is stretched to a trigger length or any other type of weight sensor.

A hook 52 is coupled to the weight sensor 50 thereby facilitating the load to be attached to the hook 52 for lifting and lowering. A pair of suspensions 54 is each coupled to the bottom side 36 of the outer wall 33 of the housing 28. Each of the suspensions 54 may comprise a hook or the like and cabling can be attached between the suspensions 54. In this way additional block and tackle can be added for increasing the weight capacity of the winch 46.

A plurality of spot lights 56 is provided and each of the spot lights 56 is coupled to the bottom side 36 of the outer wall 33 of the housing 28 to emit light outwardly therefrom. Each of the spot lights 56 is positioned adjacent to a respective one of the first end 30 and the second end 32 of the housing 28 and each of the spot lights 56 is electrically coupled to the winch 46. Each of the spot lights 56 is turned on when the winch 46 is turned on to illuminate the load. Each of the spot lights 56 may comprise an LED or other type of electronic light emitter.

A pair of handles 58 is each coupled to a respective one of the first end 30 and the second end 32 wherein for gripping and carrying the housing 28. A pair of tie downs 60 is each coupled to the outer wall 33 of the housing 28. Each of the tie downs 60 is positioned adjacent to a respective one of the first end 30 and the second end 32. Each of the tie downs 60 has a strap space 62 integrated therein and a tie down strap 64 can be extended through the strap space 62 for attaching the housing 28 to a structure.

A strobe light 66 is coupled to the front side 38 of the outer wall 33 of the housing 28 to emit light outwardly therefrom. The strobe light 66 is electrically coupled to the winch 46 and the strobe light 66 is turned on when the winch 46 is turned on. In this way the strobe light 66 visually alerts people to the potential danger of the load is lifted or lowered. The strobe light 66 may comprise an LED that emits red light or any other type of electronic light emitter. A horn 68 is coupled to the housing 28 to emit an audible alert and the horn 68 is electrically coupled to the winch 46. The horn 68 is turned on when the winch 46 is turned on to audibly alert people to the potential danger of the load is lifted or lowered. The horn 68 may be an electric horn similar to that which is found on motor vehicles.

A female electrical outlet 70 is integrated into the bottom side 36 of the outer wall 33 of the housing 28 to have a power cord 72 plugged therein. The female electrical outlet 70 is electrically coupled the winch 46 to deliver electrical current to the power cord 72. The female electrical outlet 70 may be a three prong outlet or the like and the power cord 72 may be a three prong power cord. A power supply 74 is positioned within the housing 28, the power supply 74 is electrically coupled to the winch 46 and the power supply 74 comprises at least one battery 76.

A receiver 78 is coupled to the winch unit 24 and the receiver 78 is in electrical communication with the winch unit 24. The receiver 78 is electrically coupled to the winch 46. The receiver 78 turns on the winch 46 for lifting when the receiver 78 receives a lift command. The receiver 78 turns on the winch 46 for lowering when the receiver 78 receives a lower command. The receiver 78 may comprise a radio frequency receiver 78 or the like.

A remote control 80 is provided that can be carried by a user and the remote control 80 is in wireless electrical communication with the receiver 78. The remote control 80 broadcasts the lift command to the receiver 78 when a lift button on the remote control 80 is depressed to facilitate the user to remotely actuate the winch unit 24 for lifting. The remote control 80 broadcasts the lower command to the receiver 78 when a lower button on the remote control 80 is depressed to facilitate the user to remotely actuate the winch unit 24 for lowering. The remote control 80 includes a transmitter 82 and the transmitter 82 is in electrical communication with the receiver 78. The transmitter 82 may comprise a radio frequency transmitter or the like.

A lift box 84 is provided that is attachable to the cable 26 thereby facilitating the winch unit 24 to lift or lower the lift box 84. The load is positionable in the lift box 84 thereby facilitating the winch 46 to lift or lower the load. The lift box 84 has a bottom wall 86 and a perimeter wall 88 extending upwardly therefrom, and the perimeter wall 88 has a distal edge 90 with respect to the bottom wall 86. A plurality of engagements 92 is each coupled to the distal edge 90 of the perimeter wall 88 of the box. The engagements 92 are spaced apart from each other and are evenly distributed around the distal edge 90. A plurality of rigging 94 is provided and the rigging 94 is coupled between each of the engagements 92 and the hook 52 on the cable 26. In this way the rigging 94 evenly distributes the weight of the load in the lift box 84 with respect to keeping the lift box 84 in a horizontal oriented during lifting and lowering.

In use, the scaffolding 16 is assembly to accommodate the winch unit 24 to be positioned at a preferred location for lifting and lowering the load. Each of the supports 12 is attached to the respective outrigger 14 of the scaffolding 16 and the housing 28 is positioned on top of the supports 12. Tie down strap 64*s* can be secured to each of the tie downs 60 on the housing 28 to secure the housing 28 to the scaffolding 16. The remote control 80 is manipulated to either lift or lower the lift box 84. In this way the load can be lifted without requiring the user to manually lift the load. Thus, the time required to lift a collection of bricks up to a rooftop, for example, is reduced as compared to carrying the bricks.

Figure 7:
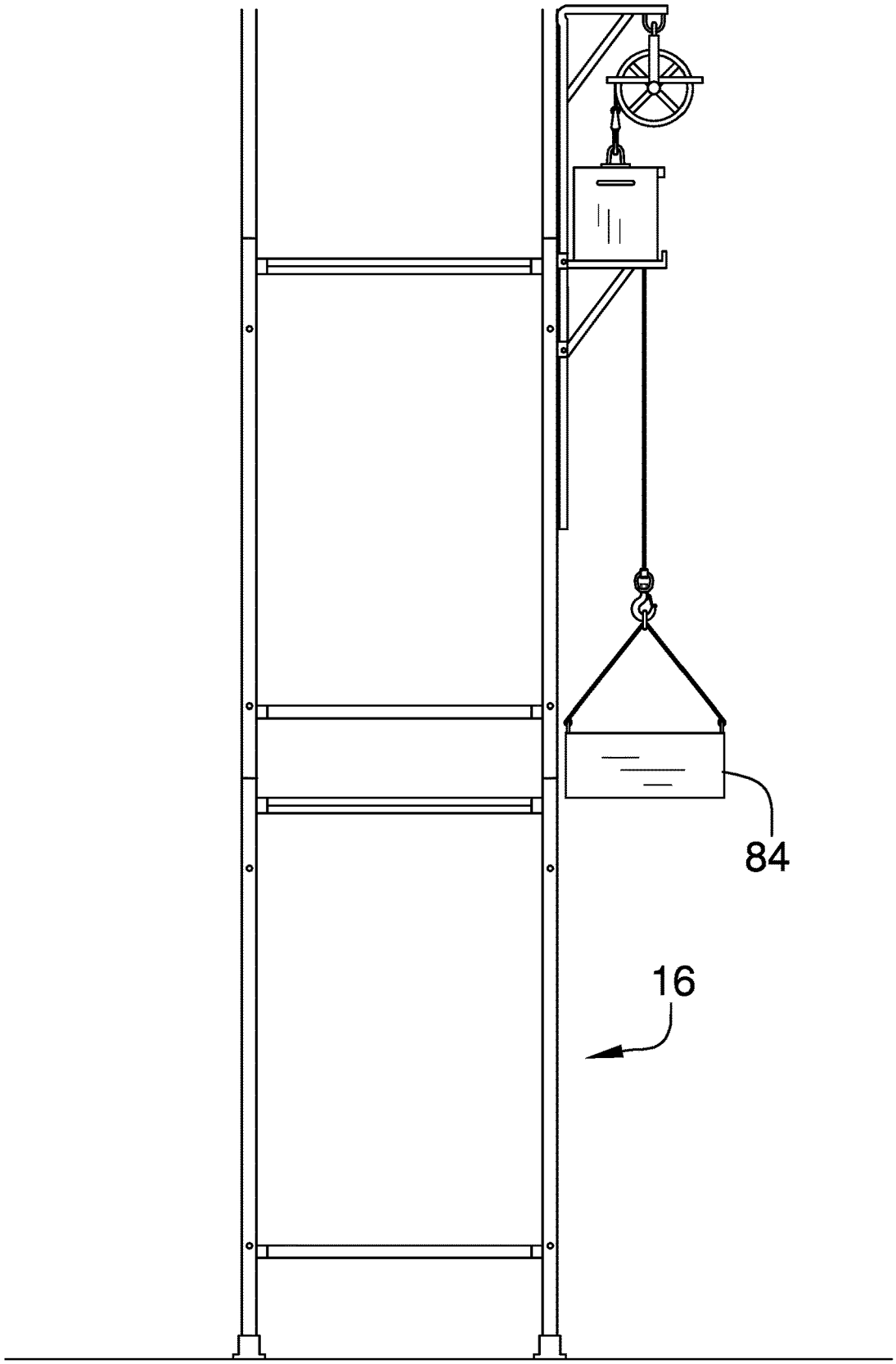
FIG. 7 is a perspective in-use view of an embodiment of the disclosure showing a winch unit being suspended from block and tackle.
Figure 8:
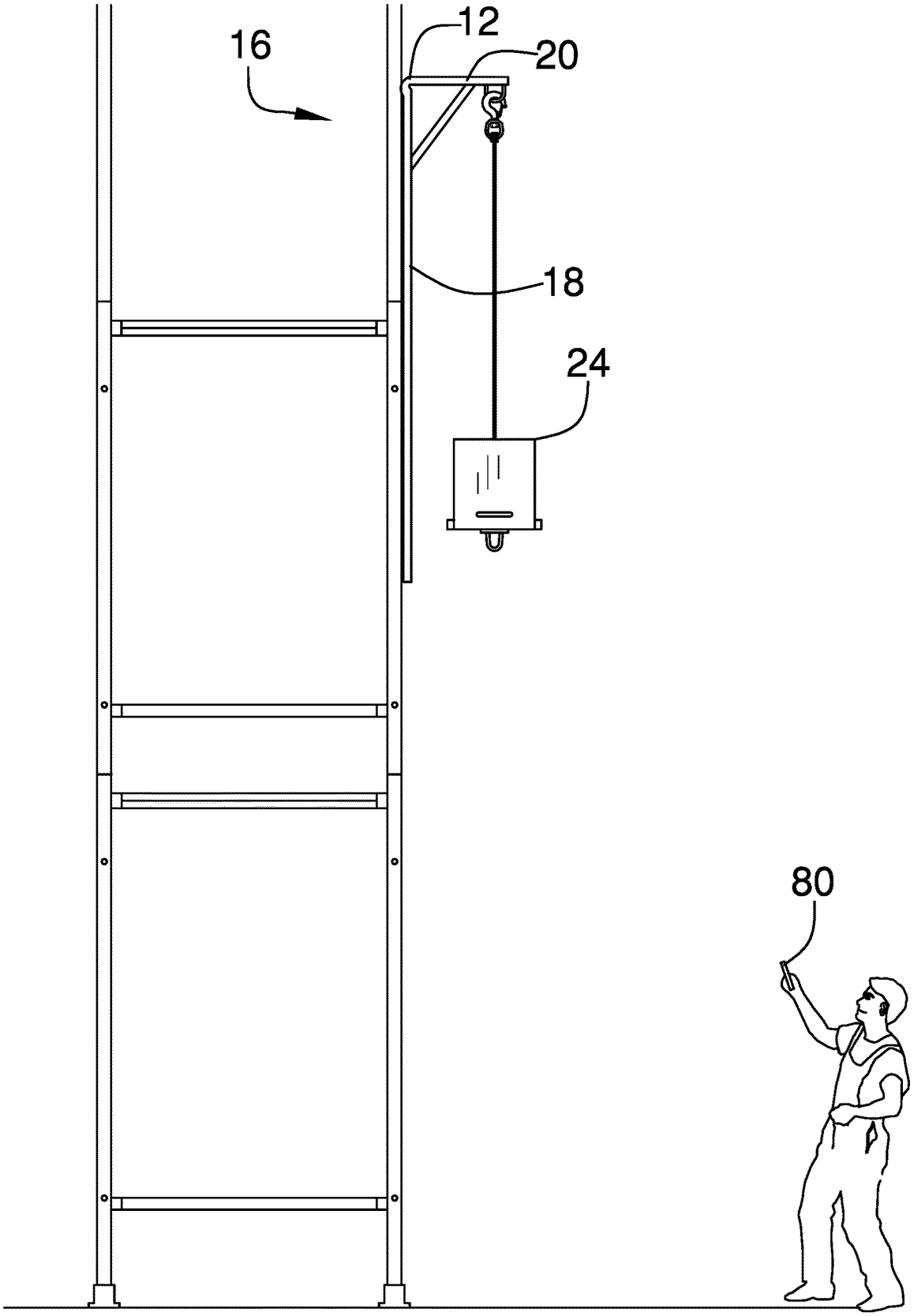
FIG. 8 is a perspective in-use view of an embodiment of the disclosure showing a winch unit being suspended by a suspension loop.
Figure 9:
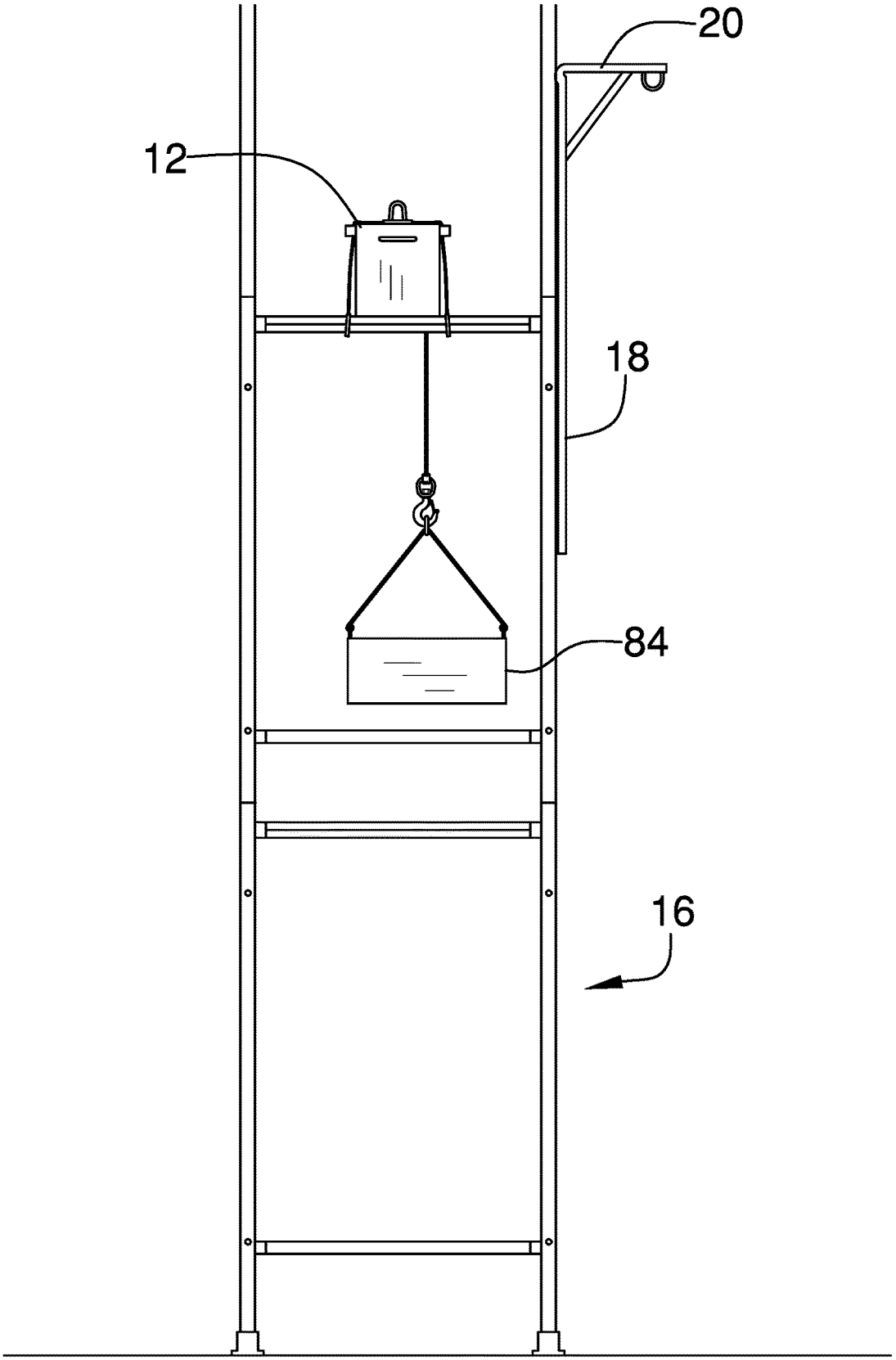
FIG. 9 is a perspective in-use view of an embodiment of the disclosure showing a winch unit being positioned within scaffolding.

As is most clearly shown in FIG. 7, a block and tackle can be attached to the suspension loop 44 on the housing 28 for enhancing the load capacity of the winch 46. As is most clearly shown in FIG. 8, the hook 52 on the cable 26 can be attached to the supports 12 thereby facilitating the winch unit 24 to be lifted and lowered. Thus, the load can be secured to the suspension loop 44 on the housing 28 for lifting and lowering. As is most clearly shown in FIG. 9, the housing 28 can be positioned within the scaffolding 16 for lifting and lowering the load within the scaffolding 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A remote controlled lift assembly for lifting cargo upwardly along scaffolding, said assembly comprising:

a pair of supports, each of said supports being mountable to a respective outrigger of scaffolding;

a winch unit being positionable on said supports when said supports are mounted on the scaffolding wherein said winch unit is configured to be spaced upwardly from a support surface on which the scaffolding is positioned, said winch unit having a cable extending downwardly therefrom, said cable being extended outwardly from said winch unit when said winch unit is actuated into a lowering condition, said cable being retracted into said winch unit when said winch unit is actuated into a lilting condition;

a receiver being coupled to said winch unit, said receiver being in electrical communication with said winch unit;

a remote control configured for being carried by a user, said remote control being in wireless electrical communication with said receiver, said remote control broadcasting a lift command to said receiver when a lift button on said remote control is depressed wherein said remote control is configured to facilitate the user to remotely actuate said winch unit, said remote control broadcasting a lower command to said receiver when a lower button on said remote control is depressed wherein said remote control is configured to facilitate the user to remotely actuate said winch unit; and wherein said winch unit comprises a housing having a first end, a second end and an outer wall extending therebetween, said housing being elongated between said first end and said second end, said outer wall having a top side, a bottom side, a front side and a back side, said bottom side having a cable aperture extending into an interior of said housing, said cable aperture being centrally positioned between said first end and said second end, a suspension loop being coupled to said top wall of said outer wall of said housing wherein said suspension loop is configured to be attached to a suspension line for suspending said housing therefrom, said suspension loop being centrally positioned between said first end and said second end for balancing said housing when said housing is suspended, a winch being positioned within said winch housing, said winch being aligned with said cable aperture, said cable being coupled to said winch, said winch turning in a first direction when said winch is turned on for lifting, said cable being wrapped around said winch when said winch turns in said first direction wherein said winch is configured to lift a load attached to said cable, said winch turning in a second direction when said winch is turned on for lowering said cable being unwrapped around said winch when said winch turns in said second direction wherein said winch is configured to lower the load attached to said cable, said cable having a distal end with respect to said winch, a weight sensor being coupled to said distal end of said cable wherein said weight sensor is configured to sense the weight of the load on said cable, said weight sensor being in electrical communication with said winch, said weight sensor sending a shut off signal to said winch when said weight sensor senses a weight that exceeds a pre-determined trigger weight wherein said weight sensor is configured to inhibit said winch from being overloaded by the weight of the load attached to said cable, a plurality of spot lights, each of said spot lights being coupled to said bottom side of said outer wall of said housing wherein each of said spot lights is configured to emit light outwardly therefrom, each of said spot lights being positioned adjacent to a respective one of said first end and said second end of said housing, each of said spot lights being electrically coupled to said winch, each of said spot lights being turned on when said winch is turned on wherein each of said spot lights is configured to illuminate the load, a pair of handles, each of said handles being coupled to a respective one of said first end and said second end wherein each of said handles is configured to be gripped for carrying said housing, a strobe light being coupled to said front side of said outer wall of said housing wherein said strobe light is configured to emit light outwardly therefrom, said strobe light being electrically coupled to said winch, said strobe light being turned on when said winch is turned on wherein said strobe light is configured to visually alert people to the potential danger of the load being lifted or lowered, a horn being coupled to said housing wherein said horn is configured to emit an audible alert, said horn being electrically coupled to said winch, said horn being turned on when said winch is turned on wherein said horn is configured to audibly alert people to the potential danger of the load being lifted or lowered, a female electrical outlet being integrated into said bottom side of said outer wall of said housing wherein said female electrical outlet is configured to have a power cord plugged therein, said female electrical outlet being electrically coupled to said winch wherein said female electrical outlet is configured to deliver electrical current to the power cord, and a lift box being attachable to said cable thereby facilitating said winch unit to lift or lower said lift box, said lift box having the load being positionable therein wherein said winch is configured to lift or lower the load, said lift box having a bottom wall and a perimeter wall extending upwardly therefrom, said perimeter wall having a distal edge with respect to said bottom wall.

2. The assembly according to claim 1, wherein each of said supports has a first member and a second member oriented at a right angle with said first member, said first member being attachable to the respective outrigger having said second member being oriented to extend along a horizontal axis, each of said supports being positionable adjacent to a top end of the scaffolding.

3. The assembly according to claim 1, wherein said winch unit includes a hook being coupled to said weigh sensor.

4. The assembly according to claim 1, wherein said winch unit includes a pair of tie downs, each of said tie downs being coupled to said outer wall of said housing, each of said tie downs being positioned adjacent to a respective one of said first end and said second end, each of said tie downs having a tie down being attached thereto for restraining said housing to a structure.

5. The assembly according to claim 1, wherein said winch unit includes a power supply being positioned within said housing, said power supply being electrically coupled to said winch, said power supply comprising at least one battery.

6. The assembly according to claim 1, wherein said receiver is electrically coupled to said winch, said receiver turning on said winch for lifting when said receiver receives said lift command, said receiver turning on said winch for lowering when said receiver receives said lower command.

7. The assembly according to claim 1, wherein said winch unit includes:

a plurality of engagements, each of said engagements being coupled to said distal edge of said perimeter wall of said box, said engagements being spaced apart from each other and being evenly distributed around said distal edge; and a plurality of rigging, said rigging being coupled between each of said engagements and said hook on said cable wherein said rigging is configured to evenly distribute the weight of the load in said box.

8. A remote controlled lift assembly for lifting cargo upwardly along scaffolding, said assembly comprising:

a pair of supports, each of said supports being mountable to a respective outrigger of scaffolding, each of said supports having a first member and a second member oriented at a right angle with said first member, said first member being attachable to the respective outrigger having said second member being oriented to extend along a horizontal axis, each of said supports being positionable adjacent to a top end of the scaffolding;

a winch unit being positionable on said supports when said supports are mounted on the scaffolding wherein said winch unit is configured to be spaced upwardly from a support surface on which the scaffolding is positioned, said winch unit having a cable extending downwardly therefrom, said cable being extended outwardly from said winch unit when said winch unit is actuated into a lowering condition, said cable being retracted into said winch unit when said winch unit is actuated into a lifting condition, said winch unit comprising:

a housing having a first end, a second end and an outer wall extending therebetween, said housing being elongated between said first end and said second end, said outer wall having a top side, a bottom side, a front side and a back side, said bottom side having a cable aperture extending into an interior of said housing, said cable aperture being centrally positioned between said first end and said second end;

a suspension loop being coupled to said top wall of said outer wall of said housing wherein said suspension loop is configured to be attached to a suspension line for suspending said housing therefrom, said suspension loop being centrally positioned between said first end and said second end for balancing said housing when said housing is suspended;

a winch being positioned within said winch housing, said winch being aligned with said cable aperture, said cable being coupled to said winch, said winch turning in a first direction when said winch is turned on for lifting, said cable being wrapped around said winch when said winch turns in said first direction wherein said winch is configured to lift a load attached to said cable, said winch turning in a second direction when said winch is turned on for lowering, said cable being unwrapped around said winch when said winch turns in said second direction wherein said winch is configured to lower the load attached to said cable, said cable having a distal end with respect to said winch;

a weight sensor being coupled to said distal end of said cable wherein said weight sensor is configured to sense the weight of the load on said cable, said weight sensor being in electrical communication with said winch, said weight sensor sending a shut off signal to said winch when said weight sensor senses a weight that exceeds a pre-determined trigger weight wherein said weight sensor is configured to inhibit said winch from being overloaded by the weight of the load attached to said cable;

a hook being coupled to said weigh sensor;

a plurality of spot lights, each of said spot lights being coupled to said bottom side of said outer wall of said housing wherein each of said spot lights is configured to emit light outwardly therefrom, each of said spot lights being positioned adjacent to a respective one of said first end and said second end of said housing, each of said spot lights being electrically coupled to said winch, each of said spot lights being turned on when said winch is turned on wherein each of said spot lights is configured to illuminate the load;

a pair of handles, each of said handles being coupled to a respective one of said first end and said second end wherein each of said handles is configured to be gripped for carrying said housing;

a pair of tie downs, each of said tie downs being coupled to said outer wall of said housing, each of said tie downs being positioned adjacent to a respective one of said first end and said second end, each of said tie downs having a tie down being attached thereto for restraining said housing to a structure;

a strobe light being coupled to said front side of said outer wall of said housing wherein said strobe light is configured to emit light outwardly therefrom, said strobe light being electrically coupled to said winch, said strobe light being turned on when said winch is turned on wherein said strobe light is configured to visually alert people to the potential danger of the load being lifted or lowered;

a horn being coupled to said housing wherein said horn is configured to emit an audible alert, said horn being electrically coupled to said winch, said horn being turned on when said winch is turned on wherein said horn is configured to audibly alert people to the potential danger of the load being lifted or lowered;

a female electrical outlet being integrated into said bottom side of said outer wall of said housing wherein said female electrical outlet is configured to have a power cord plugged therein, said female electrical outlet being electrically coupled said winch wherein said female electrical outlet is configured to deliver electrical current to the power cord; and a power supply being positioned within said housing, said power supply being electrically coupled to said winch, said power supply comprising at least one battery;

a receiver being coupled to said winch unit, said receiver being in electrical communication with said winch unit, said receiver being electrically coupled to said winch, said receiver turning on said winch for lifting when said receiver receives a lift command, said receiver turning on said winch for lowering when said receiver receives a lower command;

a remote control configured for being carried by a user, said remote control being in wireless electrical communication with said receiver, said remote control broadcasting said lift command to said receiver when a lilt button on said remote control is depressed wherein said remote control is configured to facilitate the user to remotely actuate said winch unit, said remote control broadcasting said lower command to said receiver when a lower button on said remote control is depressed wherein said remote control is configured to facilitate the user to remotely actuate said winch unit, said remote control including a transmitter, said transmitter being in electrical communication with said receiver;

a lift box being attachable to said cable thereby facilitating said winch unit to lift or lower said lift box, said lift box having the load being positionable therein wherein said winch is configured to lift or lower the load, said lift box having a bottom wall and a perimeter wall extending upwardly therefrom, said perimeter wall having a distal edge with respect to said bottom wall;

a plurality of engagements, each of said engagements being coupled to said distal edge of said perimeter wall of said box, said engagements being spaced apart from each other and being evenly distributed around said distal edge; and a plurality of rigging, said rigging being coupled between each of said engagements and said hook on said cable wherein said rigging is configured to evenly distribute the weight of the load in said box.

* * * * *